US005580442A

United States Patent [19]

Kwon et al.

[11] Patent Number: 5,580,442

[45] Date of Patent: Dec. 3, 1996

[54] METHOD FOR PRODUCING FEEDSTOCKS OF HIGH QUALITY LUBE BASE OIL FROM UNCONVERTED OIL OF FUELS HYDROCRACKER OPERATING IN RECYCLE MODE

[75] Inventors: Sook-hyung Kwon; Wha-sik Min; Yun-kil Lee, all of Seoul, Rep. of Korea

[73] Assignee: Yukong Limited, Seoul

[21] Appl. No.: 242,758

[22] Filed: May 13, 1994

[30] Foreign Application Priority Data

May 17, 1993 [KR] Rep. of Korea ..... 93-8408
Dec. 11, 1993 [KR] Rep. of Korea ..... 93-27373

[51] Int. Cl.[6] ..... C10G 69/10

[52] U.S. Cl. ..... 208/89; 208/95; 208/111

[58] Field of Search ..... 208/89, 95, 111

[56] References Cited

U.S. PATENT DOCUMENTS 3,617,498 11/1971 Kittrell ..... 208/89
3,617,501 11/1971 Eng ..... 208/89
3,644,197 2/1972 Kelley ..... 208/89
3,788,974 1/1974 Buchmann et al. ..... 208/89
4,789,457 12/1988 Fischer et al. ..... 208/89
4,902,405 2/1990 MacLean et al. ..... 208/89
4,983,273 1/1991 Kennedy et al. ..... 208/89
5,139,644 8/1992 Gruia ..... 208/89

*Primary Examiner*—Helane Myers
*Attorney, Agent, or Firm*—Seidel, Gonda, Lavorgna & Monaco, P.C.

[57] ABSTRACT

A process is disclosed for producing feedstocks for manufacturing high quality lube base oil utilizing unconverted oil, which is produced from a fuels hydrocracker unit. The first step of the process is the distillation of an atmospheric residue under vacuum in a first vacuum distillation unit to produce a vacuum gas oil. The vacuum gas oil is then hydrotreated in a first reaction unit to remove impurities and produce a treated vacuum gas oil. The treated vacuum gas oil is then subjected to hydrocracking in a second reaction unit to yield light hydrocarbons. The light hydrocarbons are then subjected to a series of fractional distillations to separate light oil products and an unconverted oil. All or a fraction of the unconverted oil is fed to a second vacuum distillation unit to produce feedstocks of high quality lube base oil and a remaining portion. The remaining portion and, optionally, a fraction of the unconverted oil is recycled from the second vacuum distillation unit to the second reaction unit.

10 Claims, 2 Drawing Sheets

METHOD FOR PRODUCING FEEDSTOCKS OF HIGH QUALITY LUBE BASE OIL FROM UNCONVERTED OIL OF FUELS HYDROCRACKER OPERATING IN RECYCLE MODE

BACKGROUND OF THE INVENTION

1. Field of the Invention

The present invention relates to a method for producing feedstocks of high quality lube base oil from unconverted oil and, more particularly, to an improvement in efficiency along with a method for continuous production of high quality lube base oil from unconverted oil produced by a fuels hydrocracker in recycle mode.

2. Description of the Prior Art

In general, a fuels hydrocracker is a process for converting vacuum gas oil (VGO) produced from a vacuum distillation unit (V1) into fuel grade hydrocarbons such as diesel fuel (as shown in FIG. 1). The VGO feed contains a large amount of impurities such as sulfur, nitrogen, oxygen, metals and other materials that are not only harmful to the catalyst system but also undesirable in the products. Such impurities are removed in a hydrotreating reaction unit (R1). The resulting hydrotreated VGO undergoes hydrocracking in a main reactor (R2) to convert a major part of it into light hydrocarbons. The reactor effluents are first separated into a hydrogen-rich gas and hydrocarbon liquid. The hydrogen rich gas is then recycled back to the two reactors (R1 and R2) while the hydrocarbon liquid is fractionated into several different grades of petroleum products through a series of fractionators (Fs). Since it is essentially impossible to accomplish 100% conversion in the reaction, a portion of the VGO feed not converted to diesel and lighter products ends up as a final fractionator bottom stream.

In fact, fuels hydrocrackers are normally designed such that the per-pass conversion (conversion achieved by a single passage through a hydrocracking reactor) is approximately 60%. The unconverted oil (UCO) is then either sent to storage as a semi-final product (this type of operation is called "once-through mode") or recycled back to the main reactor (R2) for further cracking to increase the overall conversion (this type of operation is called "recycle mode").

The UCO, because it is a mixture of highly saturated hydrocarbons, has many desirable characteristics such as a high viscosity index, which is one of the most important properties of a lube base oil. Table 1 shows typical properties for VGO and UCO for overall conversion of 85% and per-pass conversion of 60%.

TABLE 1

The Properties of the VGO and the UCO

| Properties | | VGO | UCO |
|---|---|---|---|
| API Gravity | | 22 | 38 |
| Distillation* °C. | | | |
| - IBP** | / 5% | 260/340 | 350/370 |
| - 10% | / 20% | 372/396 | 385/398 |
| - 30% | / 40% | 415/434 | 410/422 |
| - 50% | / 60% | 445/460 | 435/446 |
| - 70% | / 80% | 475/492 | 458/474 |
| - 90% | / 95% | 516/538 | 496/515 |
| - FBP*** | / %recovery | 547/98.5 | 536/99.0 |
| Hydrogen, wt% | | 12.0 | 15.0 |
| Nitrogen, wppm | | 800 | 4.0 |
| Sulfur, wt% | | 3.0 | 0.0009 |

TABLE 1-continued

The Properties of the VGO and the UCO

| Properties | VGO | UCO |
|---|---|---|
| Aniline point °C. | 78 | 118 |
| Pour Point °C. | 33 | 38 |
| Viscosity, cst | | |
| @ 40° C. | 49.9 | 19.3 |
| @ 60° C. | 19.4 | 10.7 |
| @ 100° C. | 6.35 | 4.4 |
| Viscosity Index | 64 | 143 |
| Saturation Degree of Hydrocarbon, wt% | 31 | 98 |

*ASTM D-1160, @ 760 mmHg
**Initial Boiling Point
***Final Boiling Point

From an economic standpoint, it is more advantageous to utilize the UCO for high quality lube base oil after further processing such as dewaxing and stabilization than to use UCO as a fuel oil blending stock or to recycle it to the hydrocracking reactor. Some refineries are known to be producing lube base oil with a very high viscosity index using the UCO generated from a fuels hydrocracker. For example, a refinery produces VHVI (Very High Viscosity Index) lube base oil at their lube base oil plant utilizing the UCO from their fuels hydrocracker with once-through mode. The hydrocracker plant is located far away from the lube base oil plant.

However, the above conventional method for manufacturing lube base oil from the UCO in that plant has several problems. The UCO generated from the fuels hydrocracker is fed to the lube base oil plant. In that process, several existing units are being utilized including a vacuum distillation unit, a solvent extraction unit, a solvent dewaxing unit and so on in a "blocked mode" which is quite cumbersome with rather low operation efficiency.

The above-mentioned plant, especially is inefficient because the existing vacuum distillation unit was originally designed for processing atmospheric residue (AR). It is even necessary to blend the UCO with heavier stocks such as vacuum residue (VR) before feeding it to the existing vacuum distillation unit. For a better understanding of the background of the present invention, the description for a typical fuels hydrocracker in recycle mode is given below. Refer to the enclosed FIG. 1.

Atmospheric residue (AR) is fed into a first vacuum distillation unit (V1) to produce a vacuum gas oil (VGO). The VGO is then hydrotreated in a first reactor (R1) to remove impurities such as sulfur, nitrogen, oxygen and metals. The resulting treated VGO is then hydrocracked to yield a variety of hydrocarbon products in a second reactor (R2). These hydrocarbons are separated in a series of fractionators (Fs) to produce various light oil products and diesel oil.

However, not all of the cracked hydrocarbons are converted into diesel and lighter products. A substantial portion of the hydrocarbons remain unconverted. Most of such unconverted oil is sent back to the second reaction unit (R2) for further conversion. With high-endpoint vacuum gas oil feedstocks, however, heavy refractory hydrocarbons and condensed polynuclear aromatic compounds could gradually accumulate in the fuels hydrocracker's internal recycle oil stream. An excessive concentration of these compounds can cause a rapid decline in catalyst performance and a degradation in product selectivity. In order to avoid such operational instability, a small bleed stream of unconverted oil becomes necessary to purge these compounds from the system and to maintain a suitable level of reaction activity. For that purpose, in general, the fuels hydrocracker in recycle mode recycles a small portion of the product fractionator bottoms back to the feed vacuum column (V1).

The purpose of such a recirculation scheme is to reject a portion of the refractory components and polynuclear aromatics to the vacuum residue. Such a scheme also minimizes the quantity of unconverted oil that must be purged from the product fractionator bottoms. The typical recirculation rate to the feed vacuum column is 15 to 25 liquid volume % of the total unconverted oil.

In addition, the unconverted oil from the fuels hydrocracker with high conversion has an average viscosity ranging from 4.0 to 4.5 cst at 100° C., which is too low to make 150 Neutral lube base oil. The 150 Neutral lube base oil is one of the grades with high demand and has viscosities ranging from 5.5 to 6.0 cst at 100° C. Consequently, a considerable amount of the unconverted oil at most of the existing refineries as stated above is not being utilized for lube oil production, and wasted typically in the form of fuel oil.

SUMMARY OF THE INVENTION

Therefore, the objectives of the present invention are to solve the above problems encountered in the prior art and to provide a method for producing feedstocks of high quality lube base oil. The present invention will make it possible to use the desired portion of the unconverted oil efficiently during the operation of a fuels hydrocracker in recycle mode, thereby utilizing the facilities to the maximum.

This invention is the first such approach to continuously produce feedstocks of high quality lube base oil with very high viscosity index and low volatility from a fuels hydrocracker in recycle mode.

In accordance with the first embodiment of the present invention (as shown in FIG. 2A), the above objectives can be accomplished by providing a method for producing feedstocks of high quality lube base oil, comprising the steps of distilling an atmospheric residue (AR) under vacuum in a first vacuum distillation unit (V1) to produce a vacuum gas oil (VGO); hydrotreating the vacuum gas oil in a first reaction unit (R1) to remove impurities therefrom; hydrocracking the treated vacuum gas oil in a second reaction unit (R2) to yield light hydrocarbons; applying a series of fractional distillations (Fs) to separate light oil products and an unconverted oil; feeding said unconverted oil to a second vacuum distillation unit (V2) to produce feedstocks of high quality lube base oil, having desired viscosities; and recycling the remaining portion of unconverted oil from the second vacuum distillation unit (V2) to the second reaction unit (R2).

In accordance with the second embodiment of the present invention (as shown in FIG. 2B), the above objectives can also be accomplished by providing a method for producing feedstocks of high quality lube base oil, comprising the steps of: distilling an atmospheric residue (AR) under vacuum in a first vacuum distillation unit (V1) to produce a vacuum gas oil (VGO); hydrotreating the vacuum gas oil in a first reaction unit (R1) to remove impurities therefrom; hydrocracking the treated vacuum gas oil in a second reaction unit (R2) to yield light hydrocarbons; applying a series of fractional distillations (Fs) to separate light oil products and an unconverted oil; feeding only a part of said unconverted oil to a second vacuum distillation unit (V2) to produce feedstocks of high quality lube base oil, having desired viscosities; and recycling the remaining portion of unconverted oil from the second vacuum distillation unit (V2) to the second reaction unit (R2), while recycling remainder of unconverted oil from said fractional distillations (Fs) to said second reaction unit (R2).

BRIEF DESCRIPTION OF THE DRAWINGS

Other objectives and aspects of the invention will become apparent from the following description of embodiments with reference to the accompanying drawings in which.

DETAILED DESCRIPTION OF THE INVENTION

Hereinafter, the preferred embodiments of the present invention will be described in detail with reference to the drawings above.

Figure 2A:
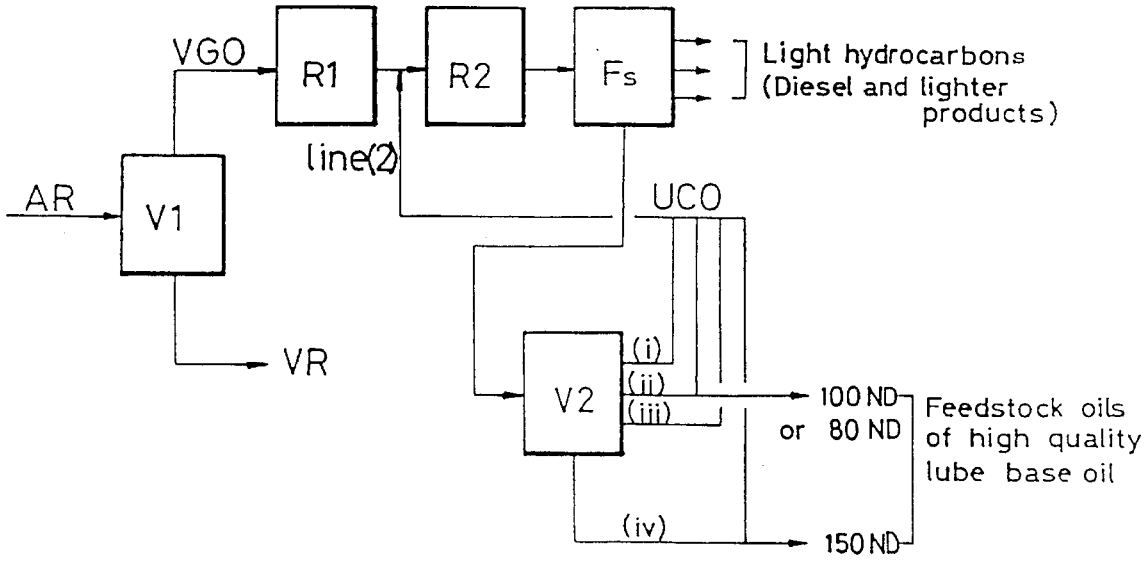
FIG. 2A is a block diagram illustrating a fuels hydrocracker and a method for producing feedstocks of high quality lube base oil according to the first embodiment of the present invention.

FIG. 2A illustrates a fuels hydrocracker and a method for producing feedstocks of high quality lube base oil according to the first embodiment of the present invention.

As illustrated in FIG. 2A, an atmospheric residue (AR) is fed into a first vacuum distillation unit (V1) to produce a vacuum gas oil (VGO) which is subsequently subjected to hydrogenation in a first reaction unit (R1).

The hydrogenating reaction proceeds to remove impurities, such as sulfur, nitrogen, oxygen and metals, from the VGO. The resulting treated vacuum gas oil enters a second reaction unit (R2) wherein the treated vacuum gas oil is hydrocracked to yield a variety of light hydrocarbons. These hydrocarbons are separated in a series of fractional distillation steps (Fs) to produce various light oil products including diesel oil.

In the meanwhile, a substantial quantity of feed hydrocarbons is unconverted. All of this unconverted oil (UCO) is sent to a second vacuum distillation unit (V2) wherein the UCO is distilled to produce feedstocks of high quality lube base oil in accordance with the first embodiment of the present invention. While the oils with desired viscosities are fractionated from the UCO in the second vacuum distillation unit (V2) and subsequently subjected to dewaxing and stabilization so as to produce the lube base oil, the remaining part of the UCO is recycled to the second reaction unit (R2).

Figure 2B:
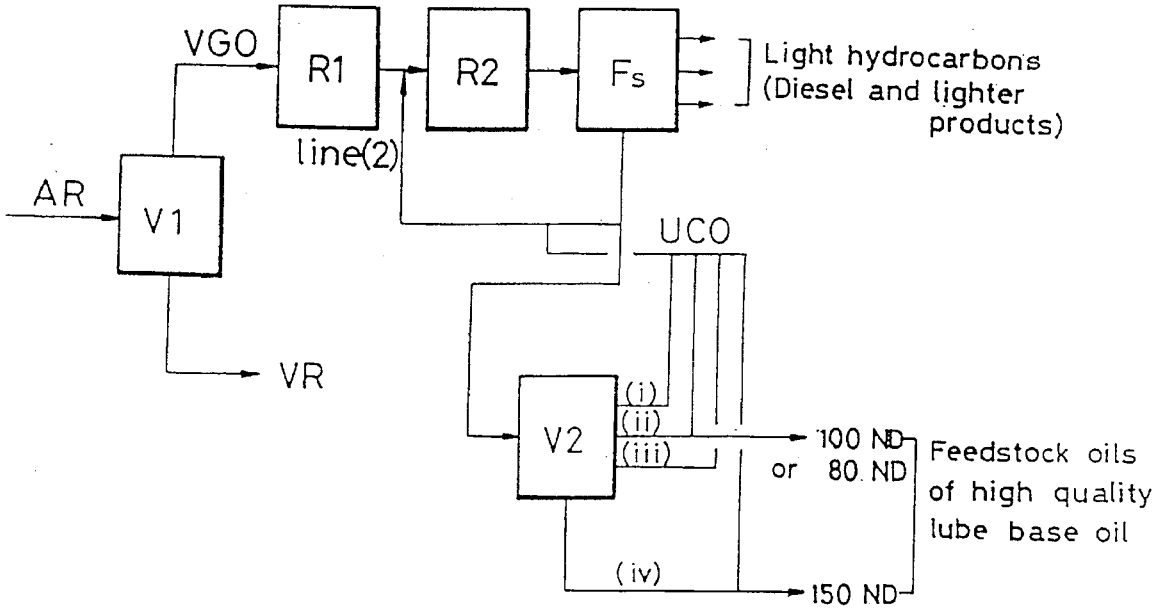
FIG. 2B is a block diagram illustrating a fuels hydrocracker and a method for producing feedstocks of high quality lube base oil according to the second embodiment of the present invention.

FIG. 2B illustrates a fuels hydrocracker and a method for producing feedstocks of high quality lube base oil according to the second embodiment of the present invention. As shown in this figure, a fraction of the UCO is taken to a second vacuum distillation unit (V2), whereas a remaining fraction of UCO is sent back to the second reaction unit (R2).

In accordance with the present invention, the additional vacuum distillation unit (V2) operating under vacuum is provided, wherein feedstocks of high quality lube base oil with appropriate viscosity grades can be produced. For example, 150 Neutral, a viscosity grade in high demand and 100 Neutral which has viscosities ranging from about 3.8 to about 4.2 cst at 100° C. can be produced as required.

It is preferable to operate the second vacuum distillation tower (V2) at temperature ranging from about 300° to about 380° C. and pressure ranging from about 20 to about 300 mmHg at the tower bottom, according to the present invention.

Figure 1:
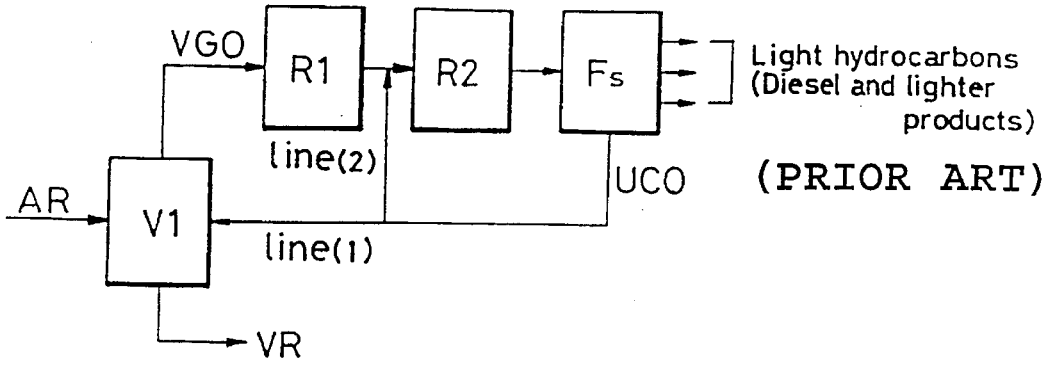
FIG. 1 is a block diagram illustrating a conventional fuels hydrocracker in recycle mode.

Referring now to FIG. 1 of prior art, the amount of the UCO that is recycled to the second reaction unit (R2) is approximately 60 to 70% of the VGO feed. Approximately 75 to 85% of the UCO (approximately 50 to 56.7% of the VGO) is recycled to the second reaction unit (R2) through line 2, and approximately 15 to 25% of it (approximately 10 to 16.7% of the VGO) is recycled to the first vacuum distillation unit (V1) through line 1.

In the present invention, all or a part of the UCO proceeds to the second vacuum distillation unit (V2), wherein it is fractionated into feedstocks of high quality lube base oil with desired viscosities. The lube base oil feedstock is approximately 15 to 25% of total UCO, which is equal to the amount sent back to the first vacuum distillation unit (V1) in the conventional process (FIG. 1). The rest, which is approximately 75 to 85% of total UCO, is recycled to the second reaction unit (R2).

According to the present invention, the ratio of total UCO from the fractional distillation step (Fs) to the UCO recycled to the second reaction unit (R2) is preferably on the order of 1.05 to 2.0:1.

In accordance with the present invention, the ratio of the UCO proceeding to the second vacuum distillation unit (V2) to the UCO recycled to the second reaction unit (R2) from the second vacuum distillation unit (V2) is preferably on the order of 1.05 to 4.0:1.

As described above, it is unnecessary to send the UCO back to the first vacuum distillation unit (V1) in the present invention. This invention is the first approach to utilize the UCO for manufacturing high quality lube base oil with very high viscosity index and low volatility continuously from a fuels hydrocracker while recycling the unused portion of the UCO back to the hydrocracking reaction unit.

The preferred embodiment of the present invention will now be further described with reference to specific examples.

EXAMPLE 1

A vacuum gas oil with the properties shown in Table 1 was processed in a hydrotreating reaction unit (R1) with a liquid hourly space velocity of 2.10 $hr^{-1}$ and treated with a catalyst, commercially available from Nippon Ketjen Company in Japan, model HC-K, at a reactor average bed temperature of 386.1° C. and reactor inlet pressure of 2,523 psig, using a hydrogen rate of 5,720 SCF/BBL of reactor feed.

Thereafter, the resulting vacuum gas oil along with the unconverted oil to be described later was processed in a hydrocracking reaction unit (R2) with a liquid hourly space velocity of 1.26 $hr^{-1}$ and treated with a catalyst, commercially available from UOP Incorporated in USA, model HC-22, at a reactor average bed temperature of 393.8° C. and reactor inlet pressure of 2,500 psig, using a hydrogen rate of 7,520 SCF/BBL of reactor feed.

Subsequently, all of the treated oil was subjected to a series of separations and fractional distillation steps (Fs) as shown in FIG. 2A, to obtain diesel and lighter products, and to give the 380° C.+unconverted oil with the properties shown in the Table 1.

All of the unconverted oil was charged to a vacuum distillation unit (V2) wherein a tower top temperature, a tower bottom temperature, a tower top pressure and a tower bottom pressure are 80° C., 325° C., 75 mmHg and 150 mmHg, respectively and distilled, so as to produce a light distillate(i) 33.0 LV %, an 100N distillate(ii) 8.3 LV %, a middle distillate(iii) 11.7 LV % and a tower bottom product(iv), 150N light distillate 47.0 LV %.

From the above distillates, the 100N and the 150N distillates amounting to 25% of the unconverted oil fed to the vacuum distillation unit (V2), i.e. 100N; 5% and 150N; 20%, were drawn out, and the rest was mixed and recycled to the hydrocracking reaction unit (R2).

The properties of the distillates are shown in the following Table 2A.

EXAMPLE 2

A vacuum gas oil with the properties shown in Table 1 was processed in a hydrotreating reaction unit (R1) with a liquid hourly space velocity of 2.10 $hr^{-1}$ and treated with a catalyst, commercially available from Nippon Ketjen Company in Japan, model HC-K, at a reactor average bed temperature of 385.9° C. and reactor inlet pressure of 2,523 psig, using a hydrogen rate of 5,710 SCF/BBL of reactor feed.

Thereafter, the resulting vacuum gas oil along with unconverted oil to be described later was processed in a hydrocracking reaction unit (R2) with a liquid hourly space velocity of 1.25 $hr^{-1}$ and treated with a catalyst, commercially available from UOP Incorporated in USA, model HC-22, at a reactor average bed temperature of 384.1° C. and reactor inlet pressure of 2,500 psig, using a hydrogen rate of 7,500 SCF/BBL of reactor feed.

Subsequently, the treated oil was subjected to a series of separations and fractional distillation steps (Fs) as shown in FIG. 2B, to obtain diesel and lighter products and to give the 380° C.+unconverted oil with the properties shown in Table 1.

Half (50%) of the unconverted oil was recycled to the hydrocracking reaction unit (R2) and the other half (50%) was charged to a vacuum distillation unit (V2) wherein a tower top temperature, a tower bottom temperature, a tower top pressure and a tower bottom pressure are 80° C., 325° C., 75 mmHg and 150 mmHg, respectively and was distilled so as to produce a light distillate(i) 32.9 LV %, an 100N distillate(ii) 8.4 LV %, a middle distillate(iii) 11.8 LV % and a tower bottom product, 150N distillate(iv) 46.9 LV %.

From the above distillates, the 100N and the 150N distillates amounting to 50% of the unconverted oil fed to the vacuum distillation unit (V2), i.e. 100N:10% and 150N:40%, were drawn-out, and the rest was mixed and recycled to the hydrocracking unit (R2).

The properties of the distillates are shown in the following Table 2B.

TABLE 2A

The Properties of the Products from UCO Vacuum Distillation Unit(V2) (for Example 1)

| Properties | | Light Distil. | 100 N Distil. | Middle Distil. | 150 N Distil. |
|---|---|---|---|---|---|
| API Gravity | | 38.8 | 38.6 | 38.4 | 37.8 |
| Distillation*°C. | | | | | |
| - IBP** | / 5 LV% | 278/289 | 377/405 | 341/408 | 424/437 |
| - 10% | / 30% | 305/402 | 406/412 | 410/424 | 442/458 |
| - 50% | / 70% | 405/414 | 421/431 | 434/447 | 471/493 |
| - 90% | / 95% | 430/437 | 446/453 | 469/483 | 514/519 |
| - FBP*** | | 462 | 482 | 520 | 523 |
| Viscosity, cst | | | | | |
| @ 60° C. | | 7.63 | 8.50 | 9.26 | 13.89 |
| @ 100° C. | | 3.45 | 3.80 | 4.19 | 5.70 |
| Viscosity Index | | 143 | 154 | 179 | 172 |
| Flash Point(COC) °C. | | 143 | 220 | 192 | 248 |
| Noack Volatility, % | | | 14.9 | | 4.8 |
| Average Molecular Weight | | 347 | 387 | 403 | 456 |
| Watson K Value | | 12.73 | 12.88 | 12.93 | 13.04 |
| Pour Point, °C. | | | 30.7 | | 35.0 |

*ASTM D-1160, @ 760 mmHg, °C., Distil. : Distillate
**Initial Boiling Point
***Final Boiling Point

TABLE 2B

The Properties of the Products from UCO Vacuum Distillation Unit(V2) (for Example 2)

| Properties | | Light Distil. | 100 N Distil. | Middle Distil. | 150 N Distil. |
|---|---|---|---|---|---|
| API Gravity | | 38.9 | 38.6 | 38.3 | 37.8 |
| Distillation*°C. | | | | | |
| - IBP** | / 5 LV% | 275/288 | 378/404 | 339/407 | 425/438 |
| - 10% | / 30% | 306/402 | 406/413 | 411/424 | 442/457 |
| - 50% | / 70% | 404/413 | 420/431 | 433/446 | 476/495 |
| - 90% | / 95% | 431/437 | 444/453 | 467/483 | 516/521 |
| - FBP*** | | 463 | 434 | 518 | 525 |
| Viscosity, cst | | | | | |
| @ 60° C. | | 7.62 | 8.50 | 9.27 | 13.89 |
| @ 100° C. | | 3.43 | 3.80 | 4.14 | 5.70 |
| Viscosity Index | | 139 | 154 | 169 | 172 |
| Flash Point(COC) °C. | | 142 | 221 | 195 | 249 |
| Noack Volatility, % | | | 15.0 | | 5.0 |
| Average Molecular Weight | | 346 | 388 | 402 | 457 |
| Watson K Value | | 12.72 | 12.88 | 12.92 | 13.04 |
| Pour Point, °C. | | | 30.9 | | 36.1 |

*ASTM D-1160, @ 760 mmHg, °C., Distil. : Distillate
**Initial Boiling Point
***Final Boiling Point As is apparent from the above Examples and Tables, it is possible to produce feedstocks of high quality lube base oil of 100N and 150N showing very high viscosity index and low volatility in accordance with the present invention.

In addition, withdrawing part of the UCO prevents the accumulation of heavy refractory hydrocarbons and condensed polynuclear aromatic compounds and frees capacity in the vacuum distillation unit (V1) and hydrotreating reaction unit (R1), allowing treatment of the vacuum gas oil in the same amount as the withdrawn lube base oil feedstock. Therefore, it has been proved that the present invention could utilize the facilities very efficiently.

Although the preferred embodiment of the present invention has been disclosed for illustrative purpose, those skilled in the art will appreciate that various modifications, addition and substitutions are possible, without departing from the scope and spirit of the present invention as disclosed in the accompanying claims.

What is claimed is:

1. A method for producing feedstocks of high quality lube base oil utilizing the unconverted oil of a fuel hydrocracker, comprising the steps of:

distilling an atmospheric residue under vacuum in a first vacuum distillation unit to provide a vacuum gas oil;

hydrotreating the vacuum gas oil in a first reaction unit to remove impurities therefrom and provide a treated vacuum gas oil;

hydrocracking the treated vacuum gas oil in a second reaction unit to yield light hydrocarbons;

subjecting the light hydrocarbons to a series of fractional distillations to separate light oil products and an unconverted oil;

feeding all of said unconverted oil to a second vacuum distillation unit to produce feedstocks of high quality lube base oil having desired viscosities and an unconverted oil remaining portion; and recycling the unconverted oil remaining portion from the second vacuum distillation unit to the second reaction unit.

2. A method according to claim 1, wherein the lube base oil feedstocks having a desired viscosity range are subjected to a further dewaxing and stabilization process, while recycling the unconverted oil remaining portion from the second vacuum distillation unit to the second reaction unit.

3. A method according to claim 1, wherein the second vacuum distillation unit is operated at a tower bottom temperature ranging from about 300° to about 380° C. under tower bottom pressures ranging from about 20 to about 300 mmHg.

4. A method according to claim 1, wherein the ratio of total unconverted oil from the fractional distillations to the unconverted oil remaining portion recycled to the second reaction unit is about 1.05:1 to 2.0:1.

5. A method according to claim 1, wherein the ratio of the unconverted oil sent to the second vacuum distillation unit to the unconverted oil remaining portion recycled to the second reaction unit from the second vacuum distillation unit is about 1.05:1 to 4.0:1.

6. A method for producing feedstocks of high quality lube base oil, comprising the steps of;

distilling an atmospheric residue under vacuum in a first vacuum distillation unit to provide a vacuum gas oil;

hydrotreating the vacuum gas oil in a first reaction unit to remove impurities and provide a treated vacuum gas oil;

hydrocracking the treated vacuum gas oil in a second reaction unit to yield light hydrocarbons;

subjecting the light hydrocarbons to a series of fractional distillations to separate light oil products and unconverted oil;

splitting the unconverted oil into a first stream and a second stream;

feeding the first stream of said unconverted oil to a second vacuum distillation unit to produce feedstocks of high quality lube base oil having desired viscosities and an unconverted oil remaining portion, while recycling the second stream of unconverted oil from said distillations to said second reaction unit; and recycling the unconverted oil remaining portion from the second vacuum distillation unit to the second reaction unit.

7. A method according to claim 6, wherein the lube base oil feedstocks having a desired viscosity range are subjected to a further dewaxing and stabilization process, while recycling the unconverted oil remaining portion from the second vacuum distillation unit to the second reaction unit.

8. A method according to claim 6, wherein the second vacuum distillation unit is operated at a tower bottom temperature ranging from about 300° to 380° C. under tower bottom pressures ranging from about 20 to about 300 mmHg.

9. A method according to claim 6, wherein the ratio of total unconverted oil from the fractional distillations to the second stream of unconverted oil and unconverted oil remaining portion recycled to the second reaction unit is about 1.05:1 to 2.0:1.

10. A method according to claim 6, wherein the ratio of the unconverted oil sent to the second vacuum distillation unit to the unconverted oil remaining portion recycled to the second reaction unit from the second vacuum distillation unit is about 1.05:1 to 4.0:1.

* * * * *